US008979434B2

(12) United States Patent
Podjadtke

(10) Patent No.: US 8,979,434 B2
(45) Date of Patent: Mar. 17, 2015

(54) TUBBING LINING HAVING AN INTEGRATED FLEXIBLE ELEMENT

(75) Inventor: Rudi Podjadtke, Herne (DE)

(73) Assignee: Bochumer Eisenhütte Heintzmann GmbH & Co. KG, Bochum (DE)

( * ) Notice: Subject to any disclaimer, the term of this patent is extended or adjusted under 35 U.S.C. 154(b) by 0 days.

(21) Appl. No.: 13/513,062

(22) PCT Filed: Dec. 1, 2010

(86) PCT No.: PCT/DE2010/001389
§ 371 (c)(1),
(2), (4) Date: May 31, 2012

(87) PCT Pub. No.: WO2011/069480
PCT Pub. Date: Jun. 16, 2011

(65) Prior Publication Data

US 2012/0237300 A1 Sep. 20, 2012

(30) Foreign Application Priority Data

Dec. 10, 2009 (DE) ..... 10 2009 057 521

(51) Int. Cl.
*E21D 11/00* (2006.01)
*E21D 11/05* (2006.01)
*E21D 11/08* (2006.01)

(52) U.S. Cl.
CPC ..... *E21D 11/05* (2013.01); *E21D 11/08* (2013.01)
USPC ..... 405/152

(58) Field of Classification Search
USPC ..... 405/150.1, 151, 152, 153; 277/628, 277/637; 114/65 R, 72–78, 88
See application file for complete search history.

(56) References Cited

U.S. PATENT DOCUMENTS

| | | | | | |
|---|---|---|---|---|---|
| 3,695,044 | A | * | 10/1972 | Hoshino et al. | 405/152 |
| 4,305,683 | A | * | 12/1981 | Wagner et al. | 405/132 |
| 4,812,084 | A | * | 3/1989 | Wagner et al. | 405/153 |
| 5,035,538 | A | * | 7/1991 | Mitchell | 405/151 |
| 5,044,823 | A | * | 9/1991 | Burgess | 405/152 |
| 5,332,334 | A | * | 7/1994 | Wagner et al. | 405/153 |
| 5,489,164 | A | * | 2/1996 | Tusch et al. | 405/152 |
| 5,713,578 | A | * | 2/1998 | Terao et al. | 277/582 |
| 5,888,023 | A | * | 3/1999 | Grabe et al. | 405/152 |

(Continued)

FOREIGN PATENT DOCUMENTS

| | | |
|---|---|---|
| AT | 395 342 B | 11/1992 |
| AT | 396 711 B | 11/1993 |

(Continued)

*Primary Examiner* — Tara M. Pinnock
*Assistant Examiner* — Patrick Lambe
(74) *Attorney, Agent, or Firm* — Henry M. Feiereisen LLC

(57) ABSTRACT

A tubbing lining for a tunnel or shaft is formed from tubbing rings having annular end surfaces, with successively tubbing rings are aligned with each other at annular end surfaces forming an annular joint. Each tubbing ring is composed of successive circumferentially arranged tubbing segments which are butt-joined. A deformable flexible element having an outer cross-sectional contour is arranged in at least one butt joint, with the cross-sectional contour parallel to the butt joint matching outer contours of the end faces such that the flexible element completely covers at least one abutting end face. The tubbing segments in conjunction with the flexible element form a prefabricated element formed of a steel reinforcing framework encased in concrete to which the flexible element is connected in a force-locked manner.

11 Claims, 10 Drawing Sheets

(56) References Cited

U.S. PATENT DOCUMENTS

| | | | | |
|---|---|---|---|---|
| 6,039,503 | A * | 3/2000 | Cathey | 404/67 |
| 6,592,296 | B2 * | 7/2003 | Gutschmidt et al. | 405/152 |
| 6,796,334 | B2 * | 9/2004 | Ishikawa et al. | 138/98 |
| 7,056,064 | B2 * | 6/2006 | Kamiyama et al. | 405/146 |
| 8,240,339 | B2 * | 8/2012 | Kamiyama et al. | 138/98 |
| 2004/0197151 | A1 * | 10/2004 | Dahl et al. | 405/151 |
| 2005/0229986 | A1 * | 10/2005 | Kamiyama et al. | 138/97 |
| 2005/0236058 | A1 * | 10/2005 | Kamiyama et al. | 138/98 |
| 2010/0139799 | A1 * | 6/2010 | Kamiyama et al. | 138/98 |

FOREIGN PATENT DOCUMENTS

| | | | |
|---|---|---|---|
| EP | 0 089 403 | A1 | 9/1983 |
| EP | 0 631 034 | A1 | 12/1994 |
| EP | 1 564 369 | A1 | 8/2005 |
| EP | 1 762 698 | A1 | 3/2007 |
| EP | 2 042 686 | A1 | 4/2009 |
| SE | 611 014 | A1 | 6/1978 |

* cited by examiner

TUBBING LINING HAVING AN INTEGRATED FLEXIBLE ELEMENT

CROSS-REFERENCES TO RELATED APPLICATIONS

This application is the U.S. National Stage of International Application No. PCT/DE2010/001389, filed Dec. 1, 2010, which designated the United States and has been published as International Publication No. WO 2011/069480 and which claims the priority of German Patent Application, Serial No. 10 2009 057 521.9, filed Dec. 10, 2009, pursuant to 35 U.S.C. 119(a)-(d).

BACKGROUND OF THE INVENTION

The invention relates to a tubbing lining for a tunnel or shaft.

The technical foundation for constructing modern subsurface structures is frequently based on insights gained from mining. In addition to the penetration of mountains with tunnel structures known from practical applications in regions with a demanding topology, there is an increased need especially in densely populated regions to construct infrastructure projects below the built-up surface. A sometimes feasible open construction method is frequently accompanied by serious interference with the above-ground use during the construction phase, so that the closed underground excavation is here also preferred. All these approaches require the obtained hollow space to be lined with at least one static load-bearing interior lining. In addition to the safe absorption of loading from the layers of earth above, in particular dynamic stress and convergence characteristics, for example caused by settling of the surrounding soil and rock, place high demands on the inner shell to be constructed for tunnels and shafts.

As already known since the mid-19th century, tubular annular segments successively arranged in the longitudinal direction, which are sometimes composed from individual segments, for example individual tubbing segments, can be used for the supporting inner shell. The required components can then advantageously be prefabricated with a reliable process and with high dimensional stability and introduced with a continuous excavation speed. The individual segments may be fabricated, for example, from cast iron or from concrete, where in the cast iron variant is also used as a lost shell for subsequent lining with concrete at the construction site. The single-shell construction method is typically preferred which simultaneously satisfies visual and static demands, while simultaneously providing a seal against hydraulic pressure.

Modern tubbing segments are nowadays used in form of prefabricated concrete segments as fixed support structure following closed shield driving. To obtain a closed static load-bearing tubbing construction, the individual tubbing sections are assembled inside the bored tube to a continuous tubbing ring. To obtain a static and water-impermeable total effect, the internally closed tubbing rings are then coupled with one another.

This produces a predetermined rigid circumference of the inner shell which does not permit adaption to deformations and other convergences of the rock formation. However, such movements begin mostly after the tunnel tube is driven in, causing compression of the rock formation surrounding the tube. This process may run at different speeds and may have a duration of several months. This noticeably increases loading of the supporting elements, which is already statically measured ahead of time and necessitates correspondingly larger dimensions of the individual components. Making the tubbing construction more economical requires this additional loading of the individual tubbing rings to be prevented by changing their respective cross-section for redistributing the surrounding forces.

EP 1 762 698 A1 discloses a flexible element for elongated subsurface spaces. In this embodiment, the flexible element is integrated between two mutually separated concrete shells arranged in the circumferential direction of the tunnel tube. The applied forces are distributed into circumferential ring forces and transferred to the flexible element, which yields under the pressure applied by the rock through compression. This embodiment has a substantially honeycomb-like structure with cavities which are reduced in size during the compression. This element satisfies its intended flexible behavior quite well.

EP 2 042 686 B1 describes an improvement of the flexible element known from EP 1 762 698 A1. This flexible element can be changed even after installation between the concrete shells by creating an increased resistance through reinforcement of the existing cavities by inserting of additional cavities. This allows in practice a better adaptation to local conditions.

The aforedescribed solutions are particularly suited for in-situ use with subsurface compound linings composed of channel profiles or lattice supports in combination with an in-situ concrete shell. The flexible element is hereby employed between two flexible in-situ concrete shells and cast in concrete into the concrete shells on both sides through a connecting reinforcement. Although the use in tubbing construction is mentioned, no practically application can be inferred, because the conventional tubbing segments are moved to the installation site as prefabricated elements, which makes subsequent integration in the hardened concrete body impossible. Moreover, tubbing segments are used in practical applications in a time-sequential method, where an in-situ incorporation of a flexible element between two tubbing segments facing each other in the circumferential direction would lead to inaccuracies, thus preventing loadbearing connections between the tubbing segments impossible. In addition, the flexible element does not have a compact structure that could be seamlessly integrated in the production of modern tubbing segments.

EP 0 631 034 B1 also discloses a controllably compressible compression bearing for tubbing segments in a tubbing ring from an elastically deformable material. This compression bearing is arranged in the butt joint between two tubbing segments that are successively combined to a tubbing ring with their end faces in a circumferential direction. The structure of the flexible element visually resembles the conventional structure of a horizontal coring brick and is predominantly composed of mutually parallel lands which intersect and thus form a plurality of continuous rectangular cavities. The cavities extend in the installed state between the opposite end faces of the tubbing segments. The elastic yieldability is controlled by filling the cavities with a plastically deformable fill mass, wherein the individual cavities may be connected with each other by passageways, thus allowing excess fill mass displaced by the compression to drain. The tubbing segments and compression bearing are connected with an adhesive. The actual pressure inside the compression bearing can be read out by integrating a pressure gauge and, if needed, reduced by draining the fill mass.

In practice, elastic materials experience aging, which may result in undesirable properties during the entire service life of the tubbing structure. The use of pressure-controlled fill masses at each of the compression bearings arranged inside the entire elongated structure requires substantial maintenance work. A decrease in the elastic properties may cause unnoticed perforation of the individual lands forming the hollow chambers, for example towards the outside of the tubbing ring which cannot be visually inspected. This would allow unimpeded draining of the fill material, which could cause an uncontrolled change in the entire geometry of the tubbing lining. However, the use of elastic materials carries certain risks even without the use of the fill material, because displacement of the elastic components under a compressive load is difficult to control. For example, "sliding" of two tubbing segments parallel to the butt joint in the lower ring half of the tubbing ring due to shear loads may endanger the ring static in the upper ring half, because the circumferential connection between the tubbing segments and the elastic compression bearings is solely based on an adhesive joint.

Based on the state-of-the-art, it is therefore the object of the invention to provide a tubbing lining as a tubular inner shell of a tunnel or shaft, which allows controlled and limited permanent load-bearing deformability in the circumferential direction, wherein the novel aspects can be seamlessly integrated in the prefabrication and the rapid installation of modern tubbing segments.

SUMMARY OF THE INVENTION

The invention provides a tubbing lining as a tubular inner shell of a tunnel or shaft having tube segments successively arranged in the longitudinal direction. The tube segments are each formed from a tubbing ring and are sealed against each other at their annular end faces at an annular joint. Each individual tubbing ring hereby includes tubbing segments which are consecutively arranged in the circumferential direction with their respective end faces, with a respective butt joint being formed between each two of the end faces. A deformable flexible element is arranged in at least one butt joint between two tubbing segments. According to the invention, at least one of the tubbing segments together with the flexible element forms a combined prefabricated element which is formed of a reinforcement framework made of steel and encased in concrete, with which the flexible element is connected by force-locking. The outer cross-sectional contour of the flexible element parallel to the butt joint hereby matches the outer contours of the end faces, whereby the flexible element completely covers at least one of the tube end faces of the tubbing segments.

The particular advantage is the force-locked connection of the flexible element with the reinforcement of one of the tubbing segments due to static and/or structural requirements, which produces a basic form which can easily processed further and which can be integrated directly into the concrete shape of the prefabricated tubbing segment. Although the flexible element may be constructed from different materials, for example plastic, it is advantageously constructed from a fireproof, aging-resistant material, for example metal. In addition to various alloys, these may also have a surface protection, such as zinc.

Together with the identical contour shapes of the flexible element in combination with one of the tubbing segments, an individual compact prefabricated element is thus provided which can be moved directly to the installation site and integrated. For example, two tubbing segments, each having half a flexible element, may thus be successively arranged in the circumferential direction of the tubbing ring, such that the two flexible elements abut each other at the butt joint and are thus combined into a single composite flexible element. The two flexible elements may be coupled together, for example, by welding, clamping or via releasable connecting means, or a combination thereof.

According to a preferred embodiment of the invention, the flexible element forms substantially a box profile with continuous hollow chambers arranged perpendicular to the circumferential direction of the tubbing ring. This box shape produces a compact and easily integratable structure which forms an almost internally closed unit. The simple shape allows a simple integration of the flexible element in the tubbing lining, filling the space of the butt joint. In particular, the force-lock to adjacent tubbing ring minimizes the complexity of a watertight structure. The continuous hollow chambers "sacrifice" themselves during the plastic deformation of the flexible element caused by the pressure from the rock through a reduction of their volume in one direction due to controlled compression. The subsequent flexible characteristic can thus be designed ahead of time based on the size and the number of the hollow chambers. In addition to the possible course of the hollow chambers perpendicular to the circumferential direction in relation to the longitudinal direction of the tunnel, the hollow chambers are advantageously oriented radially, so that they can be viewed from the inside of the tubbing lining. This allows not only a rapid visual evaluation of the deformation, but advantageously also a later introduction of, for example, elastically or plastically deformable materials and components into the hollow chambers, as well as their reinforcement by filling with concrete to produce properties similar to those of the tubbing segments.

According to one possible variant of the design of the flexible element, the hollow chambers are formed by two lands running in parallel, with each land extending between two opposing longitudinal walls extending parallel to the end faces as well as between corresponding transverse walls extending in a common plane with the annular surfaces. The individual lands hereby cross each other at right angles, forming a lattice structure. Advantageously increases the resistance at the beginning of pressure loading, because the individual lands are initially loaded in their longitudinal direction, causing them to "buckle" to produce plastic deformation.

According to another modified embodiment of the invention which incorporates the aforedescribed lattice structure, the longitudinal walls of the flexible element have an inwardly-facing curvature parallel to the longitudinal axis of the tubbing ring. The longitudinal walls make here full-area contact with the abutting end faces of the tubbing segment having matching shapes. Because the longitudinal walls of the tubbing sections extend biconcave with respect to one another and their end faces have a matching plano-convex shape, only one side of the flexible element has a fixed connection with one of the end faces of the tubbing segment, whereas the opposite side only makes shape-adapted contact with the end face of the other tubbing segment. This produces an articulated effect between the adjacent tubbing segments in the circumferential direction, allowing an angular adjustment with respect to each other. Notwithstanding the deformation-free mobility, which occurs for example with an uneven change in the cross-section of the tubbing lining, the position of the two tubbing segments with respect to each other is clearly defined, enabling shear forces to be reliably transmitted between the semi-circularly shaped longitudinal walls as well as the end faces. This effect is particularly advantageous also for transferring shear forces when both end faces of the tubbing segments are connected with the interposed flexible element.

Referring to the biconcave embodiment of the longitudinal walls, in another advantageous embodiment the two longitudinal walls of the flexible element are each formed of a side panel embodied as a hollow profile having a cross-section shaped as a segment of an arc. Each arc of the circle of the segment of an arc is located in the corresponding shape-adapted end faces of the tubbing sections. The respective plano-convex shape of the longitudinal walls then also produces the aforedescribed advantages of an articulation with a one-sided connection of the flexible element with one of the tubbing segments, as well as an improved transfer of the shear forces. The embodiment of the longitudinal walls as a hollow profile also simplifies the manufacture of the lattice structure produced internally from lands, because each of the employed hollow profiles has on the side facing the arc of the circle a straight surface extending parallel to the lands, between which the transverse lands extend and are terminated in a straight fashion.

According to the invention, the flexible element in one variant to the lattice structure has two opposing planar opposing longitudinal walls extending parallel to the two end faces of the tubbing segments, and that the interposed hollow chambers are formed from individual tubular bodies. The tubular bodies are each arranged in a row parallel to the longitudinal walls and make contact with each other along the circumference. At least one intermediate land, at which the individual tubular bodies are secured in the respective orientation, is disposed between two adjacent rows. At the beginning, the ground cross-sectional shape of the tubular bodies slightly reduces the resistance with respect to the lattice structure, because the outside surfaces of the tubular bodies are directly subjected to bending stress. In general, the tubular bodies in a row may also have a mutual distance between their respective outside surfaces commensurate with the radius, so that the yieldability of the tubular cross-section up to its planar deformation takes place without contact. By successively arranging the tubular bodies, the outside surfaces support each other, so that the respective deformation must take place towards the inside of the tubular cross-section, which increases the resistance. To adapt to specific requirements, the resistance of the flexible element may be deliberately "adjusted" via the thickness of the wall as well as the diameter, spacing and the number of tubular bodies and the number of rows of tubular bodies. The hollow spaces inside and between the tubular bodies can here also be filled similar to the lattice structure.

Advantageously, considering a subsurface lining cooperating as a total system, an adjusting element may advantageously be arranged in the butt joint between the end faces of the tubbing segments, allowing a distance between the end faces to be changed with the adjusting element. Even if the adjusting element may be arranged outside the butt joint disposed between the adjacent butt joints, for example in the tubbing segments or generally next to the annular plane and is coupled with the tubbing segments by way of a suitable connection, the arrangement according to the invention with the adjusting element disposed in the circumferential plane of the individual ring sections is preferred. This produces a compact closed system which advantageously can statically transfer the existing ring forces. In addition, the interior volume of the tubbing lining can be optimally used by integrating of the adjusting element inside the tubbing rings.

Alternatively, the flexible element is a compressible part of the aforementioned adjusting element or is combined with the adjusting element inside the individual tubbing rings. Through the combination within a component, the scope of the prefabrication is enhanced and a uniform production process is enabled.

According to a preferred embodiment of the tubbing lining, by varying the tubbing rings along the circumference, the tubbing rings may be connected with each other via a coupling unit to provide three-dimensional flexibility. The coupling unit is hereby a releasable connection. The tubbing rings can then "breathe" differently through respective relative changes in the circumference of the tubbing rings without significant stress, because adjacent tubbing rings can thus assume different diameters, without being hindered by a rigid connection with the adjacent tubbing rings. Overall, the individual segments are hereby securely and exactly positioned relative to each other, simultaneously providing considerable freedom for three-dimensional movement.

According to a preferred embodiment, a leak-tight contact between the flexible element and an adjacent tubbing ring in the longitudinal direction of the tubbing lining or with a differently shaped tube segment inside the annular joint can be produced with a flexible element having a corresponding recess for a seal oriented toward the annular surfaces of the tubbing ring. This recess extends along the sides of the flexible element between the two end faces of the tubbing segments and forms in cross-section a substantially semi-circular area. This embodiment can generally also be used with the adjusting element. In addition to the attained sealing action, in particular the shape of the recess ensures secure and accurate positioning of a rope seal inside the annular joint which is also maintained during possible movements of the tubbing rings with respect to each other coplanar with the annular surfaces. The end faces of the tubbing segments themselves have corresponding seals, with the end faces then sealing directly against each other or against components disposed in the butt joint. The employed adjusting element and the flexible element can be combined directly with seals overlapping with the respective element from the outside circumference. In other embodiments, the elements may already represent an integral seal.

Advantageously, a seal which extends continuously around the annular surface may be incorporated in the annular joint between the tubbing rings and additional tube sections in combination with the recess on the flexible element. The closed shape form by an O-ring securely seals the annular surfaces against each other to prevent a possible intrusion of surrounding water. In addition to potentially present groundwater, this approach should basically also to be included in all structures below the water surface. Even when the seal is composed of individual sections and is able to provide an effective seal, a one-piece circular solid rubber seal is advantageously used. The force caused by the pressure inside the annular joint due to coupling of the tubbing rings with each other is sufficient to attain the required degree of sealing. By forming a continuous annular groove inside the annular surfaces, in analogy to the recess of the flexible element and of the adjusting element, the respective movements of the tubular sections relative to one another are safely absorbed by deformations and highly accurate positioning of the seal.

According to another embodiment of the invention, in particular under extreme conditions, the seal may be formed of a solid material or of a radially flexible hose that can be filled with different media. Introduction of a medium into the interior of the hose causes an elastic change in the cross-section of the hose seal, which produces its sealing effect even when no pressing force or only a small pressing force is present inside the annular joint, by generating the necessary pressing force on its own through a volume increase. The seal can also be filled and compressed later through a valve reachable from the inside of the tubbing lining, which creates a connection to the interior of the seal in form of a stub. In addition to gaseous media, for example also permanently elastic or hardenable materials may be introduced into the seal. Advantageously, the hose seal is hereby provided with a second stub allowing a medium residing inside the seal and displaced during subsequent pressing to be discharged.

The tubbing lining according to the invention thus meets the stringent demands of a modern single-shell interior lining which can be flexibly handled. In addition to providing a coupling between two adjacent rings segments which yields in three dimensions, the coupling unit or components thereof can be easily accessed and exchanged at a later date. In combination with an adjusting element or a flexible element or with a combination of the two, the three-dimensionally yielding coupling allows different "breathing" in form of changes in the circumference of the individual ring segments without introducing significant stress. The adjacent rings segments can thus assume different diameters without being hindered by a rigid connection with adjacent rings segments. Overall, the individual segments are hereby securely and exactly positioned with respect to one another, while simultaneously allowing movement in three dimensions.

By designing each one of the ring segments to actively adapt its circumference to the particular situations, the resulting simplified handling and the significantly expanded design space adds value in practical applications. Overall, installation is simplified and often accelerated, because each individual coupling unit of the ring segments can be easily accessed and the otherwise rigid shape of the inner shell can be readily adapted. With the combination with passive flexible elements and three-dimensionally yielding coupling units, a person of skill in the art now has at his disposal an efficient modular system that can be adapted on-site for the modern interior lining of subsurface structures, in particular of tunnels and shafts.

BRIEF DESCRIPTION OF THE DRAWING

The invention will now be described in more detail with reference to exemplary embodiments schematically illustrated in the drawings, which show in.

DETAILED DESCRIPTION OF PREFERRED EMBODIMENTS

Figure 1:
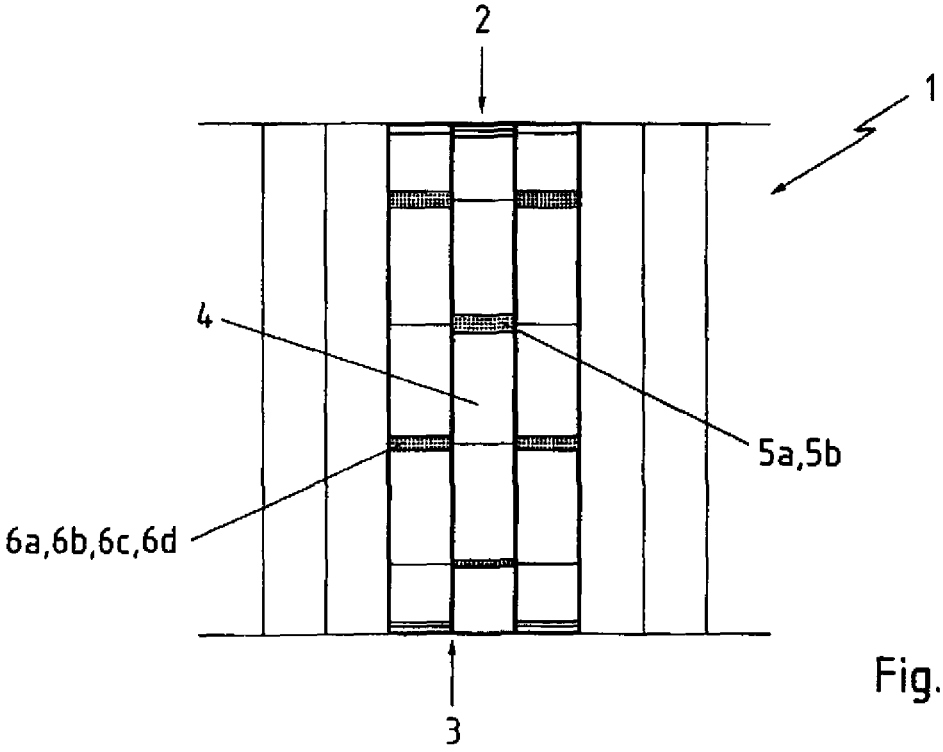
FIG. 1 in a side view, a tubbing lining according to the invention as a detail of a continuous tunnel tube.

FIG. 1 shows as a detail the individual components of a tubbing lining 1 in an side outside view of a tunnel tube formed of three illustrated and also indicated tubbing rings 2 successively arranged in the longitudinal direction. A corresponding continuous annular joint 3 is disposed between the individual tubbing rings 2. The tubbing rings 2 are constructed of tubbing segments 4 consecutively arranged in the circumferential direction, wherein a corresponding adjusting element 5*a*, 5*b* or a corresponding flexible element 6*a*, 6*b*, 6*c*, 6*d* is arranged between several of the adjacent tubbing segments 4 in the circumferential direction.

Figure 2:
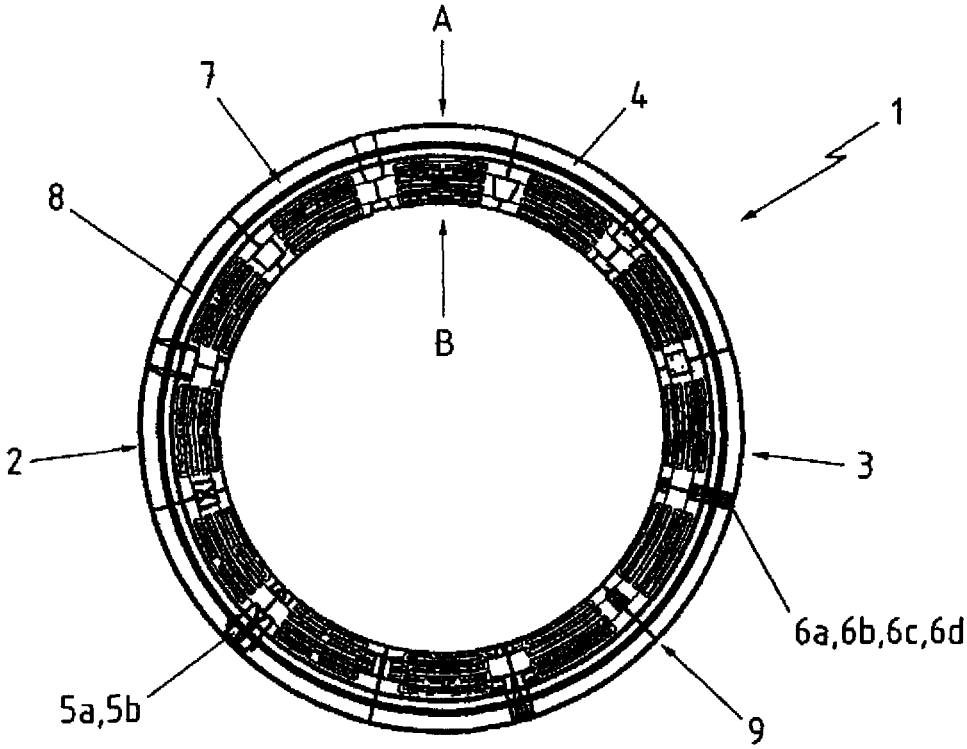
FIG. 2 the tubbing lining of FIG. 1 in a front view, as viewed in the direction of the longitudinal axis along the interior of the lining.

As viewed in the longitudinal direction of the tunnel, FIG. 2 represents a perspective interior view of the circular tubbing rings 2. One of two annular surfaces 7, by which the tubbing rings 2 are oriented with respect to each other, extending continuously around the circumference are visible on the front part of the tubbing rings 2. In the region of the annular surfaces 7, a continuous circular seal 8 can be seen which extends inside the annular joint 3 and seals the tubbing rings 2 against each other. A corresponding butt joint 9 is arranged between respective two tubbing segments 4 in the circumferential direction of the tubbing rings 2, with the adjusting element 5, 5*b* or the flexible element 6*a*, 6*b*, 6*c*, 6*d* being arranged inside the butt joint 9. The butt joint 9 extends radially from an outside A to an inside B of the tubbing rings 2.

Figure 3:
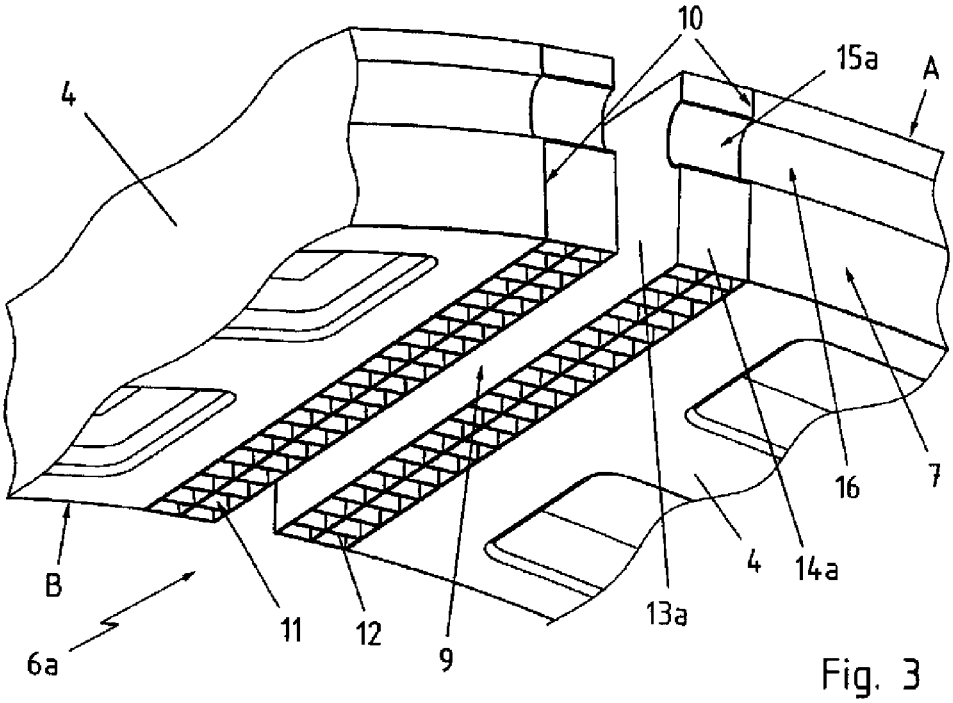
FIG. 3 a detail of two adjacent tubbing segments in a tubbing ring, each having a half of a compressible flexible element.

FIG. 3 shows the detail of to tubbing segments 4 facing each other in the butt joint 9, wherein their two respective end faces 10 are each connected with one half of a flexible element 6*a*. Each of the tubbing segments 4 hereby forms with one half of the flexible element 6*a* a common prefabricated element, wherein the respective half of the flexible element 6*a* is connected with a force-lock with an unillustrated reinforcement framework made from steel of the reinforced concrete body of the tubbing section 4. The outer cross-sectional contour of the flexible element 6*a* parallel to the butt joint 9 corresponds hereby to the outer contours of the end faces 10, completely covering the two end faces 10. Each of the two halves of the flexible element 6*a* is thus formed of a box profile having hollow chambers 11 extending from the inside B to the outside A. The hollow chambers 11 are formed by mutually parallel lands 12 which extend between two opposing longitudinal walls 13*a* of the respective box profile which extend parallel to the end faces 10 as well as two transverse walls 14*a* extending coplanar with the annular surfaces 7. The lands 12 intersect here at right angles. Each of the transverse walls 14*a* has a corresponding recess 15*a* which positively engages in an annular groove 16 of the tubbing rings 2 extending circumferentially on the annular surface 7.

Figure 4:
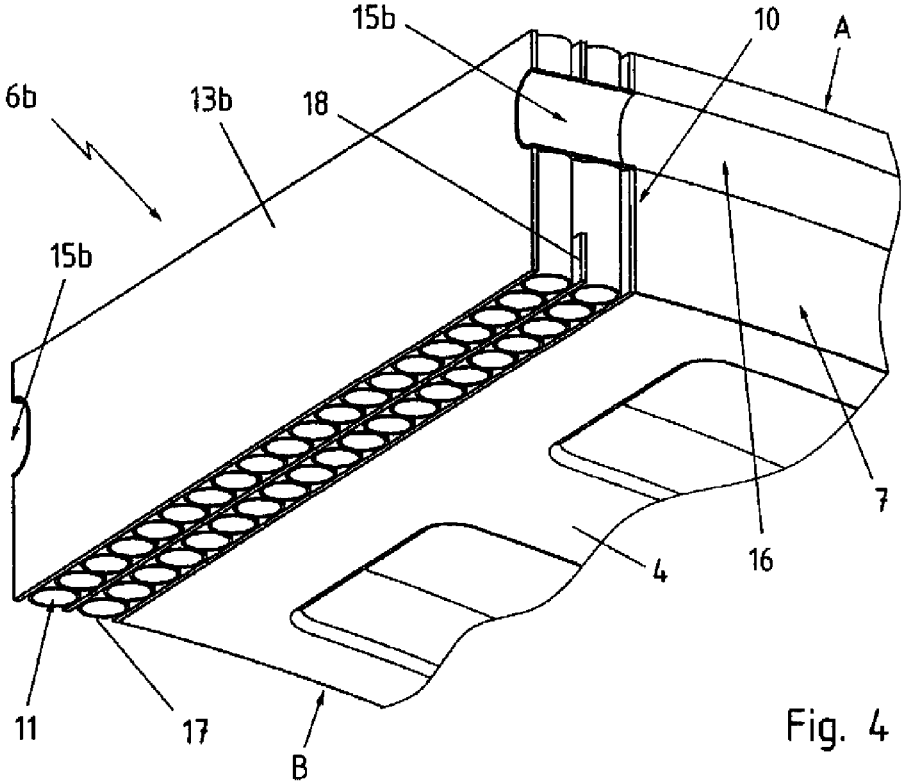
FIG. 4 a detail of a flexible element in a variant of FIG. 3, with one of the tubbing segments having changed interior shapes.

FIG. 4 shows a variant of the of the flexible element 6*a* already illustrated in FIG. 3, showing only one of the tubbing segments 4 in combination with one half of a flexible element 6*b*. The flexible element 6*b* is hereby formed by two opposing longitudinal walls 13*b* arranged parallel to one of the end faces 10. The outer cross-sectional contour of one of the longitudinal walls 13*b* here also completely covers one of the end faces 10. The hollow chambers 11 disposed between the two longitudinal walls 13*b* are here formed from individual tubular bodies 17, which are each arranged in a row parallel to the longitudinal walls 13*b* and are in contact with one another along the circumference. The tubular bodies 17 hereby form two rows which are separated from each other by a narrow metal strip forming an intermediate land 18. The shape of the circumferential annular groove 16 along the annular surfaces 7 is hereby formfittingly received by a recess 15*b* disposed on the two sides of the flexible element 6*b* in a respective plane of the annular surfaces 7.

Figure 5:
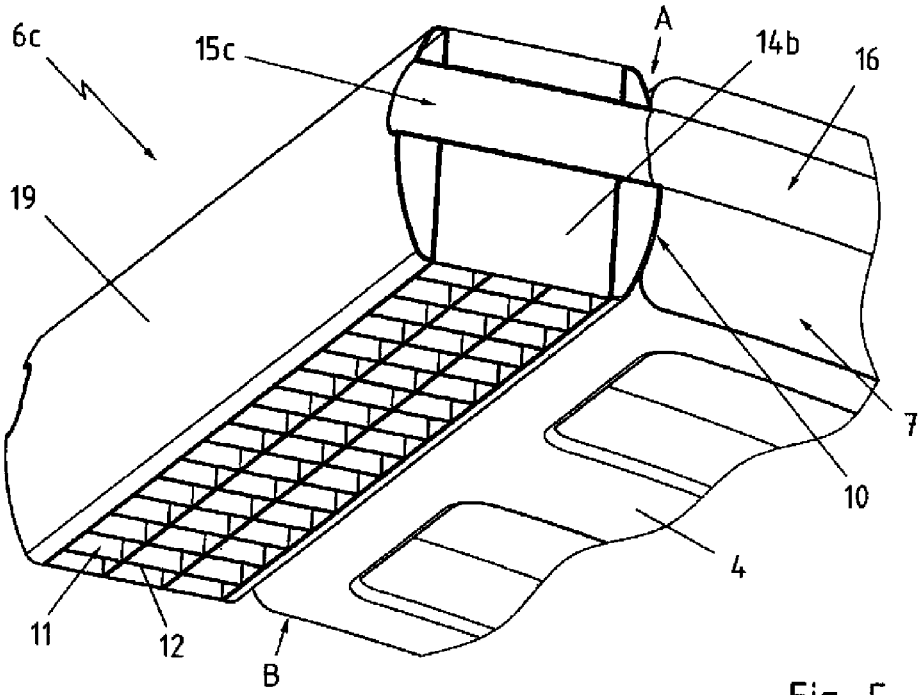
FIG. 5 a detail of a flexible element in a variant of FIG. 4 in an identical diagram in combination with one of the tubbing segments.

FIG. 5 shows a variant of a flexible element 6*c* having a substantially one-piece box profile. In analogy to FIG. 3, the individual hollow chambers 11 are here also formed by lands 12 intersecting at right angles. Each of the two longitudinal walls 19 parallel to the butt joint 9 is formed of hollow profiles having a cross-sectional shape in form of a segment of a circle. The circular arc of one of the longitudinal walls 19 hereby contacts with a matched shape one of the end faces 10 and is connected by a force-lock with the (unillustrated) reinforcement of one of the tubbing segments 4. The sides of the flexible element 6*c* located coplanar with the annular surfaces 7 have closed transverse walls 14*b*, with a corresponding recess 15*c* arranged at an extension of the circumferential annular groove 16. This recess 15*c* extends here beyond the transverse walls 14*b* to the two outer circular arcs of the respective longitudinal walls 19.

Figure 6:
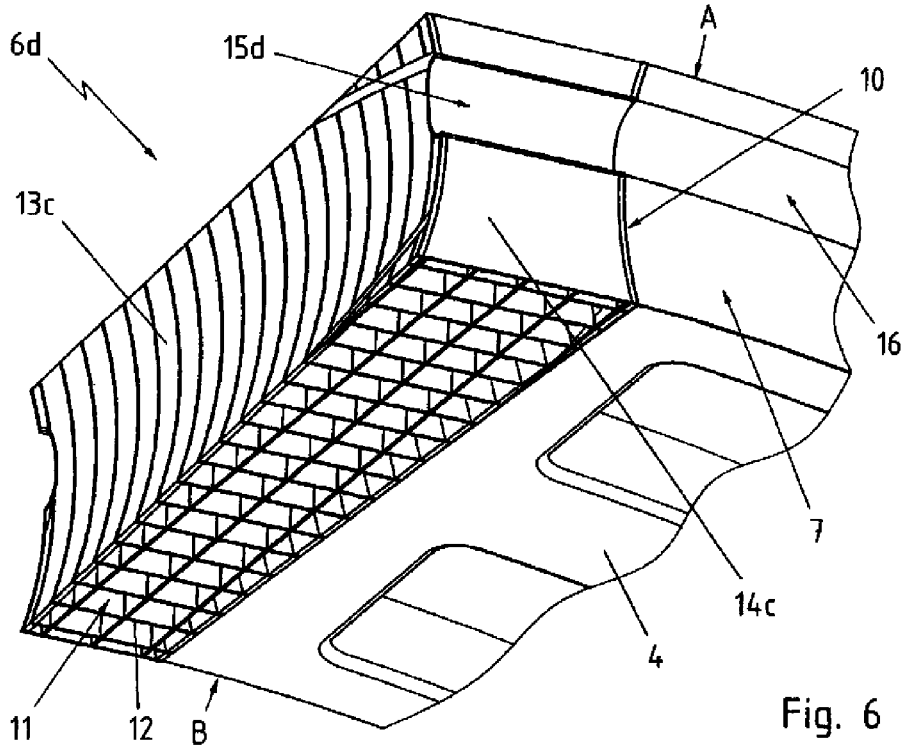
FIG. 6 a flexible element in a variant of FIG. 5 in an identical view with changed side faces.

FIG. 6 shows another variant of the flexible element 6*d* which corresponds with its arrangement of the hollow chambers 11 to the exemplary embodiment illustrated in FIG. 5. The two sidewalls extending parallel to the end faces 10 are herein not formed by a hollow profiles, but instead by longitudinal walls 13*c* having a concave curvature facing the interior region of the flexible element 6*d*. In analogy to FIG. 5, the transverse walls 14*c* disposed coplanar with the annular surfaces 7 have recesses 15*d* which provide a formfitting extension of the circumferential annular groove 16.

Figure 7:
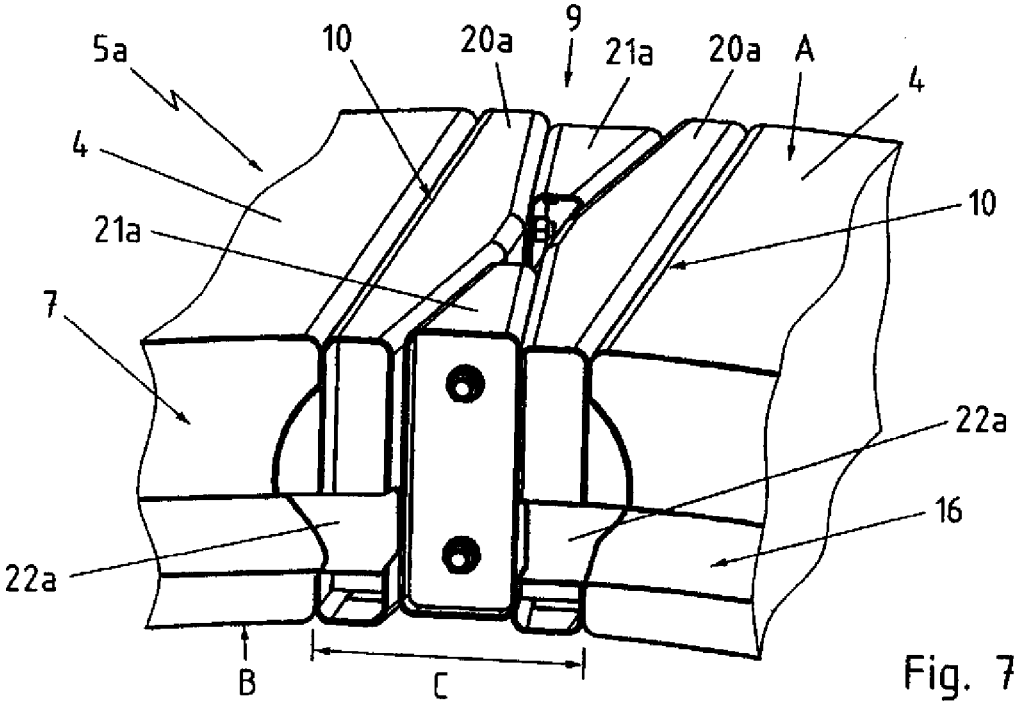
FIG. 7 a perspective view of an adjusting element according to the invention inside the detail of two tubbing rings.

FIG. 7 shows the adjusting element 5*a* arranged inside the butt joint 9 between two tubbing segments 4 separated by a distance C and facing each other with their end faces 10. The adjusting element 5*a* has essentially two side panels 20*a* facing each other in opposite directions (mirror-image) coplanar with the butt joint 9, as well as a wedge-shaped spreading element 21*a* facing the two outer annular surfaces 7. The spreading element 21*a* is disposed opposite the other spreading element 21*a* perpendicular to and in opposite direction of the butt joint 9 (mirror-image). The detail of the continuous annular groove 16 introduced in the annular surfaces 7 is visible coplanar with the annular surfaces 7. The annular groove 16 extends through the parts of the adjusting element 5*a* located coplanar with the annular surfaces 7 and forms a corresponding recess 22*a* in each of the two side panels 20*a*. The circumferential shape of the annular groove 16 enabled insertion of the circular seal 8.

Figure 8:
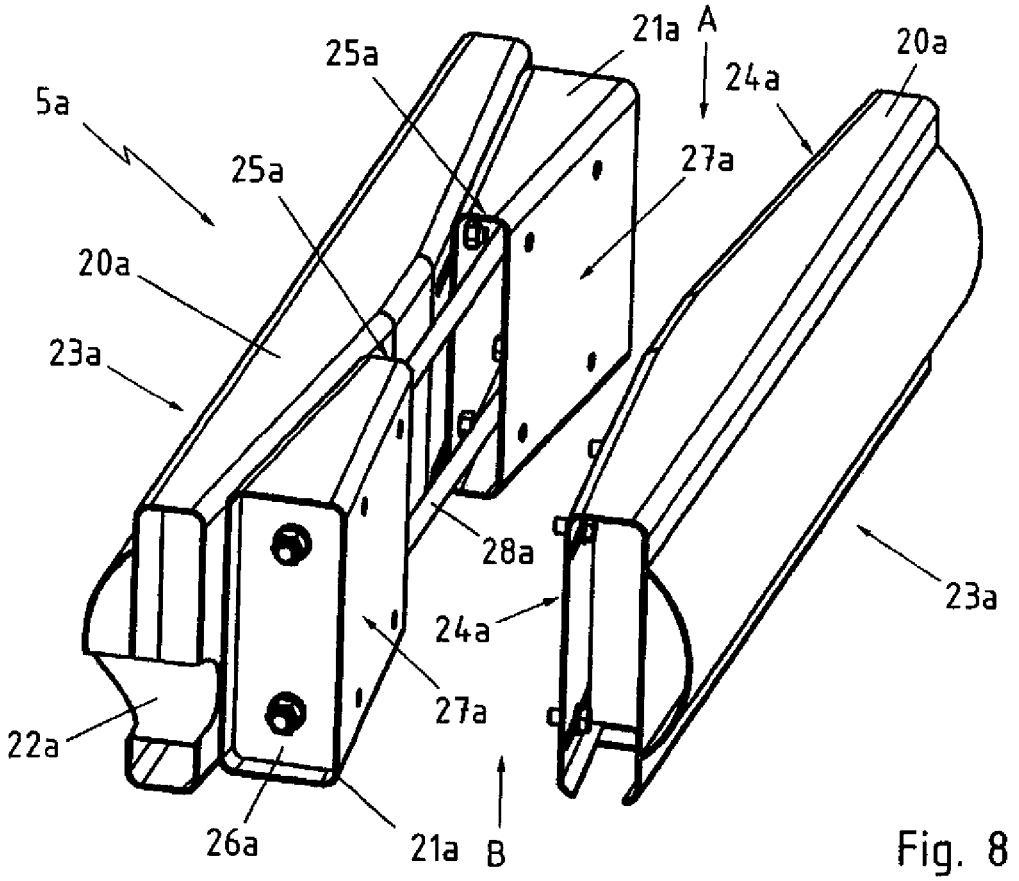
FIG. 8 the adjusting element extracted from the tubbing ring according to the diagram of FIG. 9 in a partially exploded view.

To better illustrate the individual components of the adjusting element 5*a*, FIG. 8 shows the adjusting element 5*a* with the side panels 20*a* pulled apart. Each of the side panels 20*a* has an elongated box profile which completely covers the end faces 10 of the tubbing segments 4 in FIG. 7 with its connecting side 23*a*. In addition, the connecting side 23*a* has a curvature formed from sheet metal, which in cross-section forms a segment of a circle, wherein the apex of the segment of the circle extends behind the corresponding end faces 10 of the shape-adapted tubbing segments 4, as shown in FIG. 4.

On a side of the box profile facing the connecting side 23*a*, the box profile is formed with two inclined planes, whereby the two side panels 20*a* have opposing inclined faces 24*a* with a common highest edge region located at the center of the side panels 20*a* and flattening out on both sides of the tubbing rings 2 linearly towards the annular surfaces 7, whereby the respective cross-section of the side panels 20*a* is tapered towards the two recesses 22*a* located at the edge.

The wedge-shape gaps between the two side panels 20*a* which open towards the front-side annular surfaces 7 are each at least partially filled by the wedge-shape spreading element 21*a*; the wedge-shape gaps oppose each other with their blunt wedge tip 25*a*, as already illustrated in FIG. 7.

A side of the spreading element 21*a* facing the wedge tip 25*a* is formed as an anchor plate 26*a*. The two sides of the wedge-shaped spreading element 21*a* extending parallel to the inclined faces 24*a* each have corresponding pressure areas 27*a* which are in full-area contact with the inclined faces 24*a* of the side panels 20*a*. The spreading element 21*a* is coupled via releasable connecting means with the respective side panels 20*a* of the adjusting element 5*a*. The side panels 20*a* have each slots arranged in their inclined faces 24*a* to allow linear movement of the spreading element 21*a* between the two side panels 20*a*, with the slots extending in a longitudinal direction between the two front-side annular surfaces 7 and displaceably supporting the releasable connecting means and hence the respective spreading element 21*a*. The spreading element 21*a* is connected with the opposite spreading element 21*a* by two tension anchors 28*a*, which are arranged mutually parallel and extend from the anchor plate 26*a* to the anchor plate 26*a* by passing through the corresponding spreading element 21*a* and the respective anchor plate 26*a*. The tension anchors 28*a* are rotatably supported inside the spreading element 21*a* and have at one end a hex head which can be engaged by conventional tools for force transmission, wherein the opposite end of the tension anchor 28*a* has an exterior thread which is in engagement with a corresponding element fixedly connecting with the anchor plate 26*a* and having a corresponding interior thread. Each of the side panels 20*a* has a recess 22*a* at the corresponding ends of the adjusting element 5*a* facing the annular surfaces 7 of the tubbing rings 2, with the recess 22*a* extending from a connecting side 23*a* of the side panels 20*a* to the opposite connecting side 23*a* coplanar with the annular surfaces 7.

Figure 9:
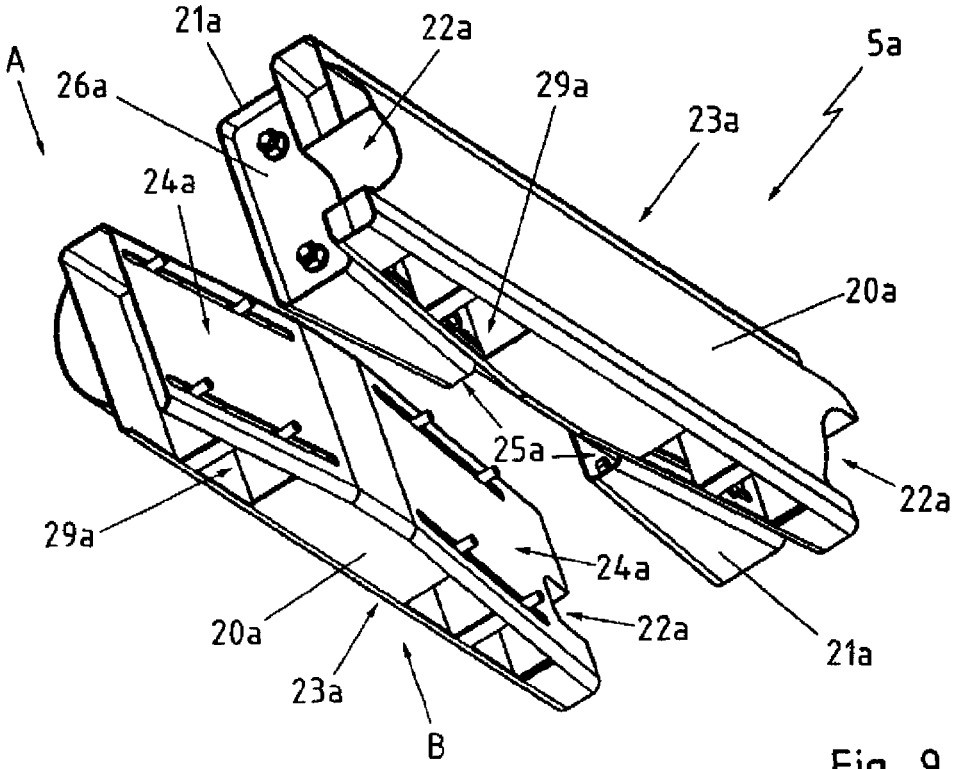
FIG. 9 the adjusting element according to the diagram of FIG. 8 in a changed perspective.

FIG. 9 shows service openings 29*a* disposed in the side panels 20*a* of the adjusting element 5*a* which can be accessed from the inside B of the tubbing rings 2 for accessing the releasable connecting means which displaceably couple the spreading element 21*a* with the respective side panels 20*a*. The service openings 29*a* in the side panels 20*a* can only be accessed from the inside B of the tubbing rings 2, whereas the side panels 20*a* towards the outside A of the tubbing rings 2 are closed across their entire surface.

Figure 10:
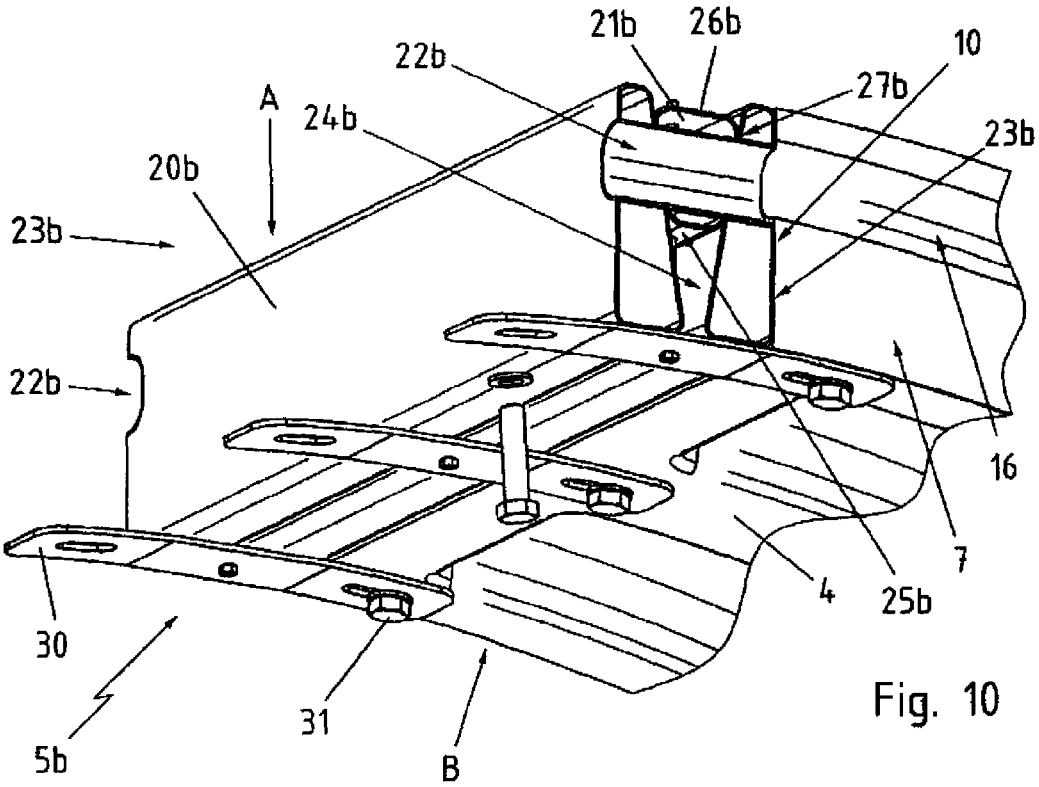
FIG. 10 an adjusting element in a variant of FIGS. 7 to 9 with one of the tubbing segments in a detail in perspective view.

FIG. 10 shows a variant of an adjusting element 5*b* which is connected on one side to the end face of one of the tubbing segments 4. The adjusting element 5*b* has substantially two elongated wedge-shape side panels 20*b* which face each other in opposing directions (mirror image) parallel to one of the end faces 10. The connecting side 23*b* of one of two side panels 20*b* is in full-area contact with one of the end faces 10, completely covering the end face 10. The opposing sides of the side panels 20*b* are each constructed as an inclined plane formed between them a wedge-shaped gap which is tapered from the outside A to the inside B. The inclined planes are here each formed by inclined faces 24*b*, between which a wedge-shaped spreading element 21*b* is arranged, which also extends across the respective width of the tubbing rings 2, wherein the inclined side faces take up only half the height between the outside A and the inside B and terminate in a blunt wedge tip 25*b*. A side of the spreading element 21*b* opposite the wedge tip 25*b* is formed as a continuous anchor plate 26*b*. The inclined side faces of the spreading element 21*b* are here formed as pressure faces 27*b* making full-area contact on both sides with the inclined faces 24*b* of the adjusting element 5*b*. The continuous annular groove 16 of the individual tubbing rings 2 here also extends through the parts of the adjusting element 5*b* disposed coplanar with the annular surfaces 7 and forms a respective continuous recess 22*b* between the two side panels 20*b*. Three symmetrically arranged transverse straps 30 are arranged coplanar with the inside B, which extend lengthwise in the circumferential direction of the tubbing rings 2 and have slots at their respective ends. The slots are each located behind the end faces 10, so that the transverse straps 30 are coupled with one of the tubbing segments 4 via releasable connecting means 31. Whereas one of the transverse straps 30 extends in the center of the tubbing rings 2, the other two transverse straps 30 are each located proximate to the outer annular surfaces 7, without protruding over the respective width of the tubbing rings 2.

Figure 11:
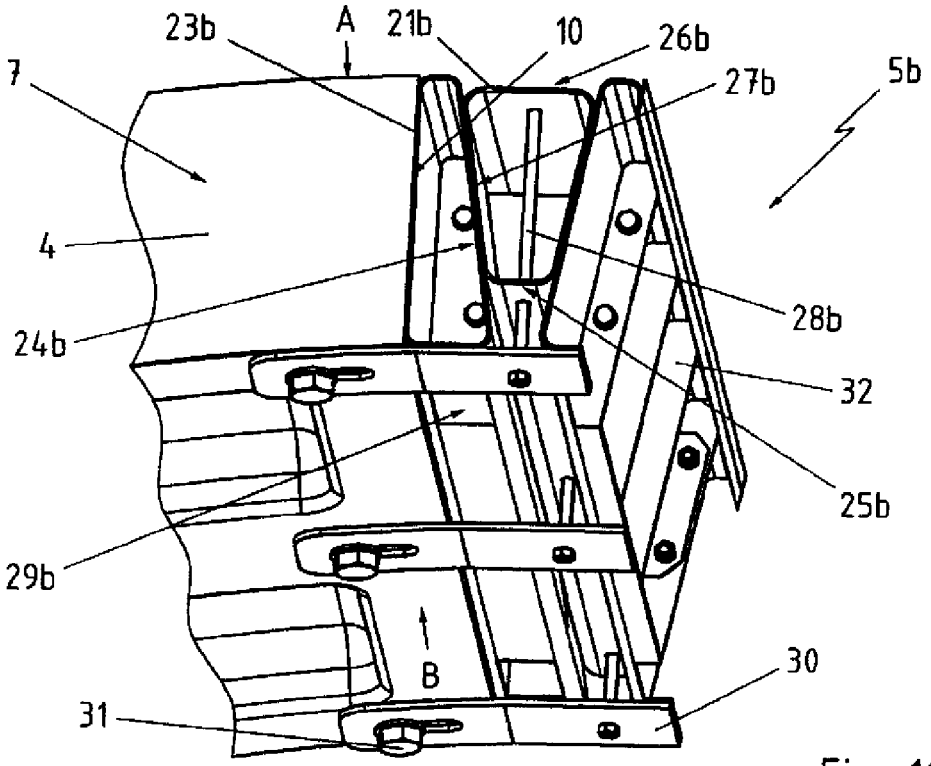
FIG. 11 the adjusting element according to the diagram of FIG. 10 with partially sectioned components in a change perspective.

FIG. 11 illustrates in a different perspective view additional details of the adjusting element 5*b*, wherein a section through one of the side panels 20*b* offers a view into the interior. The side panels 20*b* and the spreading element 21*b* are here each formed from hollow profiles which are reinforced by transverse walls 32 extending perpendicular to the longitudinal direction. The adjusting element 5*b* has three mutually parallel tension anchors 28*b*, which each extend from the inside B through the center of the transverse straps 30 to the anchor plate 26*b*, passing through the spreading element 21*b* on the wedge tip 25*b* and on the anchor plate 26*b*. The ends of the tension anchors 28*b* that are accessible from the inside B include a hex head which can be engaged by conventional tools, wherein the tension anchors 28*b* themselves are rotatably supported in the transverse straps 30 and the spreading element 21*b*.

Figure 12:
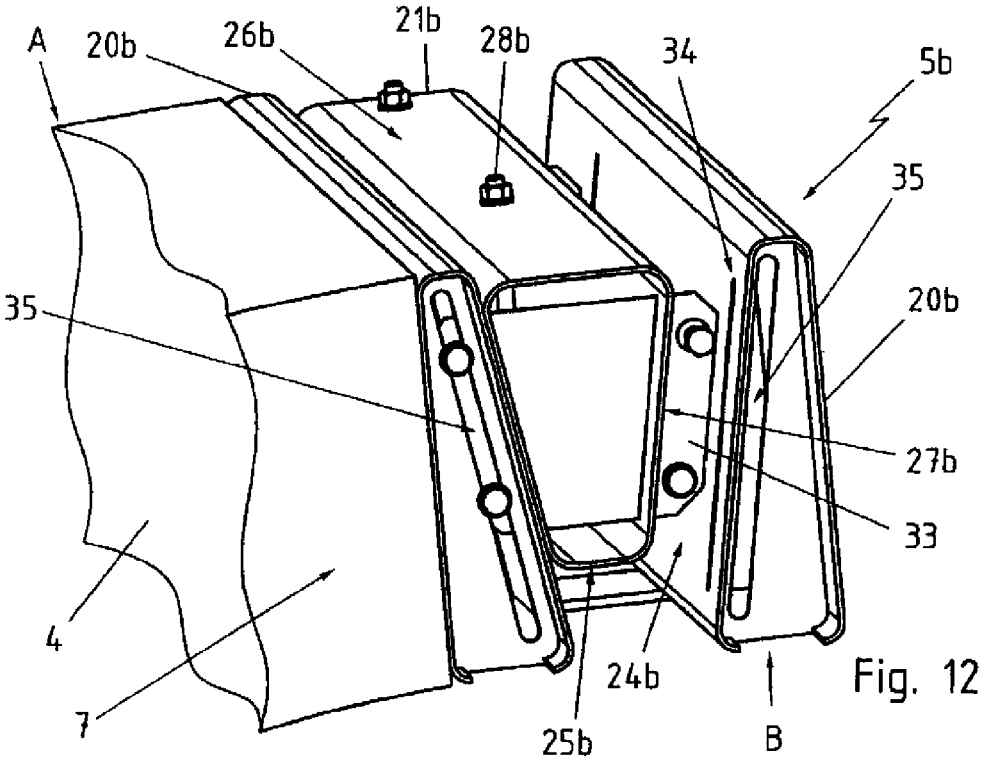
FIG. 12 the adjusting element according to the diagrams of FIGS. 10 and 11 in a partially exploded view with partially sectioned components in a changed perspective.

As shown in FIG. 12, the end on the side opposite the hexagonal head of the tension anchors 28*b* has an exterior thread which is in engagement with the interior thread of elements that are fixedly connected with the anchor plate 26*b*. As can be seen in the partial exploded view, the spreading element 21*b* includes guide walls 33 protruding over its pressure faces 27*b*, wherein the transverse walls 32 extent parallel to the annular surfaces 7 of the tubbing rings 2 and project into the side panels 20*b* through corresponding slots 34 disposed in the inclined faces 24*b*. Releasable connecting means, which in turn engage for displacement with guide slots 35 in the transverse walls 32 of the side panels 20*b*, are arranged at the ends of the guide walls 33 disposed in the respective panels 20*b*.

Figure 13:
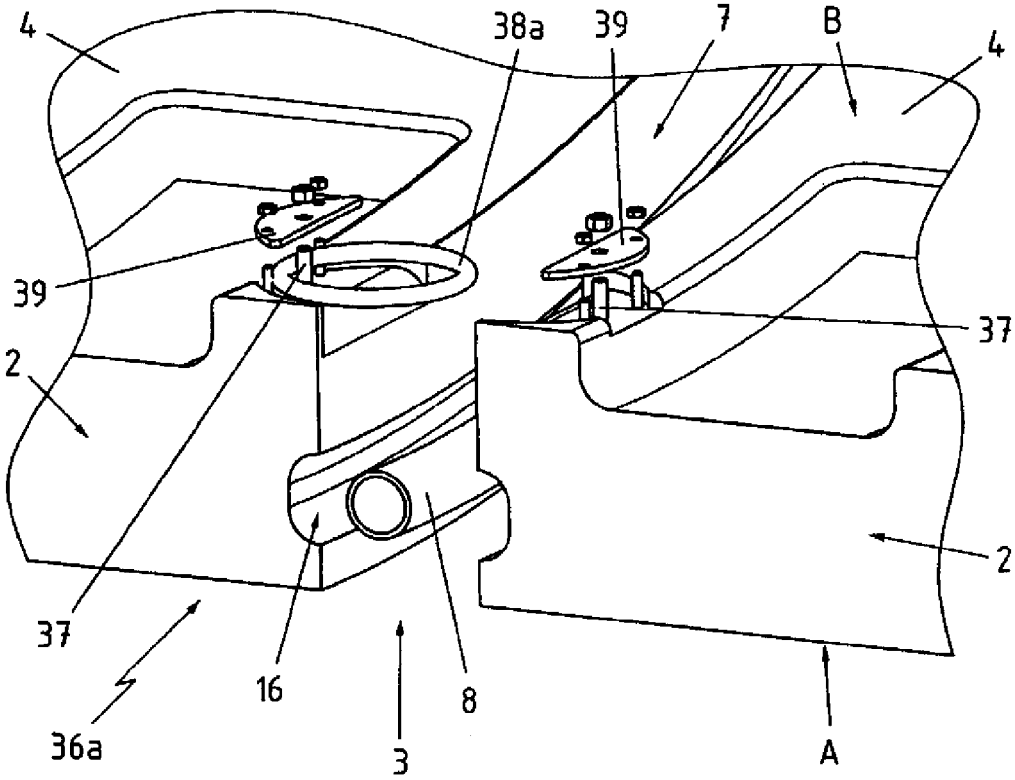
FIG. 13 a detail of two adjacent tubbing rings in a perspective view with a coupling unit in an exploded view.

FIG. 13 shows an exemplary embodiment illustrating the connection between two adjacent tubbing rings 2. For better illustration, the annular joint 3 is here shown with a large gap, offering a view onto one of the continuous annular surfaces 7 and the continuous annular groove 16 arranged therein. The continuous seal 8 coplanar with the annular groove 16 is illustrated as a tubular body. A coupling unit 36*a* for connecting the two tubbing rings 2 which essentially includes two connected counter bearings is shown in an exploded view. The counter bearings are here each arranged in form of anchor pins 37 in one of the tubbing sections 4 proximate to the annular surfaces 7 in the region of the inside B. The anchor pins 37 are fixedly connected with the tubbing segments and are each perpendicular on the inside B of the two tubbing rings 2. A coupling element in form of a ring component 38*a* is arranged for connecting the two anchor pins 37 with each other, with the coupling element disposed in a shape-adapted recess in the tubbing segments 4 and surrounding opposing anchor pins 37. Two additional rod-shape elements which like the anchor pins 37 have an exterior thread are arranged in addition to the anchor pins. To fix the position of the ring component 38*a* parallel to the inside B of the respective tubbing rings 2 about the anchor pins 37, each coupling unit 36*a* to the anchor pins 37 has a semicircular coupling plate 39, which is placed on the anchor pins 37 and the rod-shape elements of the coupling unit 36*a* by way of corresponding holes and secured on the exterior thread by way of releasable connecting means in form of a hex nuts screwed.

Figure 14:
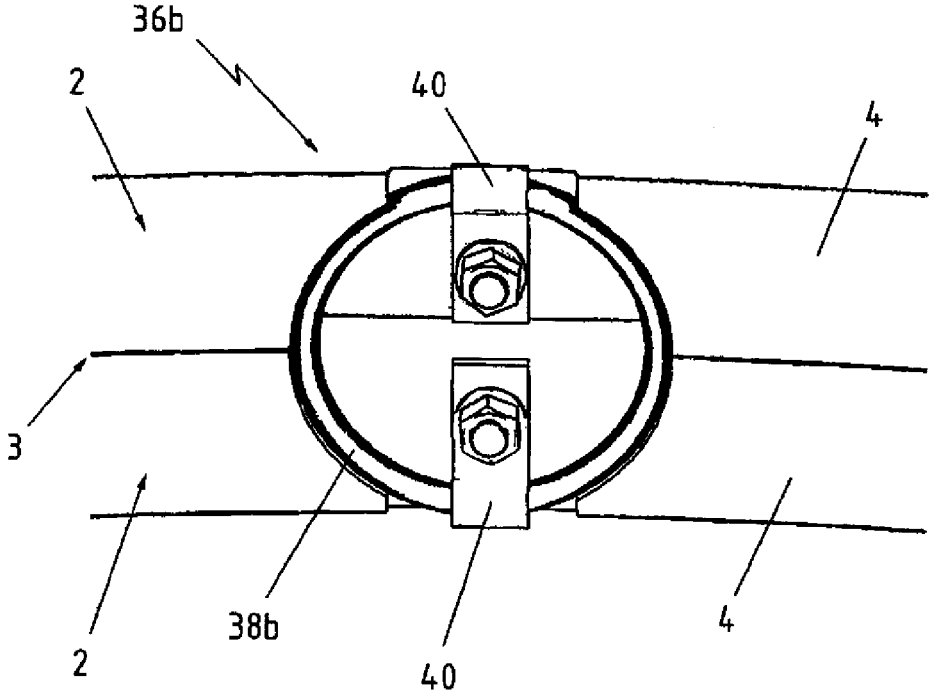
FIG. 14 a coupling unit as a variant of FIG. 13 in a top view with a changed attachment.

FIG. 14 shows in a top view a variant of the exemplary embodiment of FIG. 13 in form of a coupling unit 36*b*, wherein two counter bearings are formed as clamping plates 40. The tubbing sections 4 have here also semicircular recesses in the region of the coupling unit 36*b*, in which a ring component 38*b* is integrated by way of the annular joint 3 and clamped on the clamping plates 40. The two clamping plates 40 are here coupled with the tubbing segments 4 via a releasable connecting means.

Figure 15:
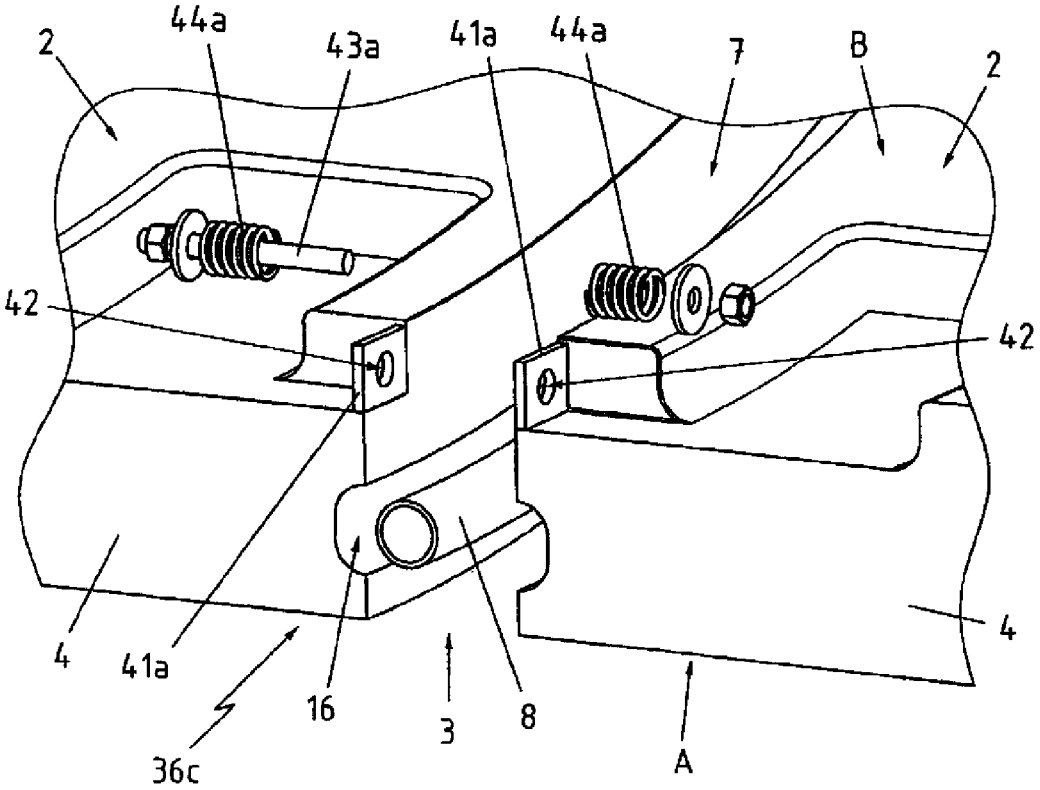
FIG. 15 a coupling unit according to the diagram of FIG. 13 in a variant with a rod-shaped connecting element.

FIG. 15 shows another variant of a coupling unit 36*c*, which similar to FIGS. 13 and 14 connects two opposing counter bearings to provide three-dimensional yieldability. The counter bearings are here each formed by an anchor plate 41*a* extending coplanar with, the annular surfaces 7 and having a through-hole as a clearance opening 42 and being fixedly connected with one of the tubbing segments 4. To connect the two counter bearings with one another, the coupling unit 36*c* is illustrated in an exploded review as a rod-shape bolt 43*a* passing through each individual clearance opening 42 of the anchor plate 41*a*. The bolt 43*a* hereby represents a releasable connecting means and has a significant excess length, wherein the diameter is at least 50% smaller than the diameter of the respective hole of the anchor plates 41*a*. Spring elements 44*a* in form of coil springs are placed on the bolt 43*a* on both sides of the counter bearings, so that the two bolt ends are springily supported about the clearance opening 42 by the coil springs with respect to the respective anchor plate 41*a*.

Figure 16:
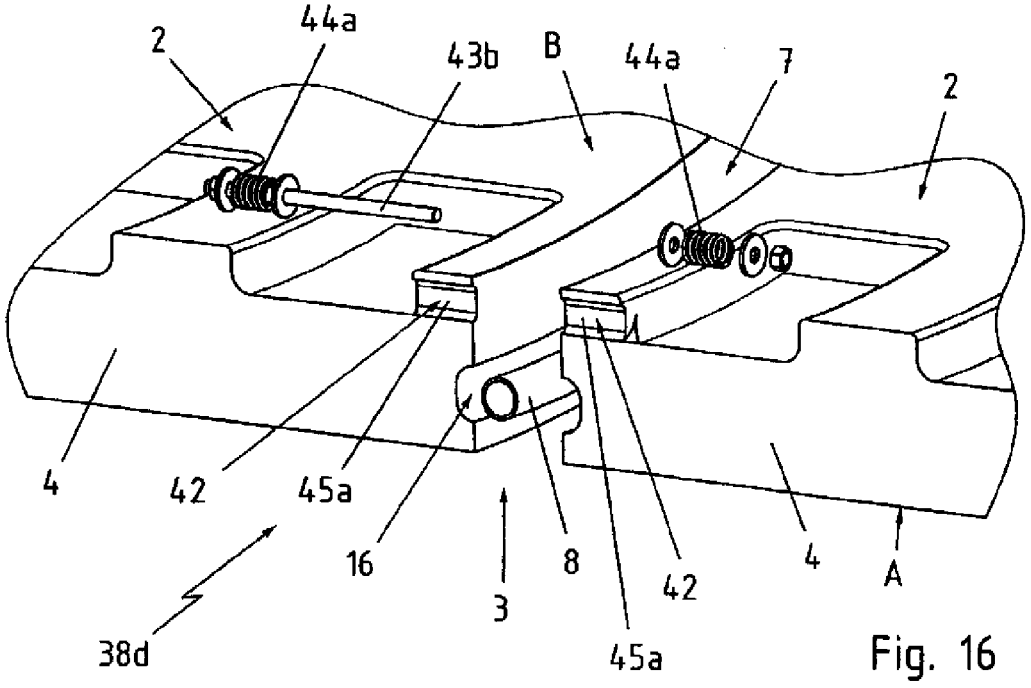
FIG. 16 a coupling unit according to the diagram of FIG. 15 in a variant with changed coupling faces.

In a second variant, FIG. 16 shows a coupling unit 36*d* which includes in addition to two counter bearings to be connected also a bolt 43*b* and the spring element 44*a* at both ends. The bolt 43*b* is hereby significantly longer, because the counter bearings are each formed by a recess 45*a* in form of a continuous clearance opening 42 within a land of the tubbing segments 4.

Figure 17:
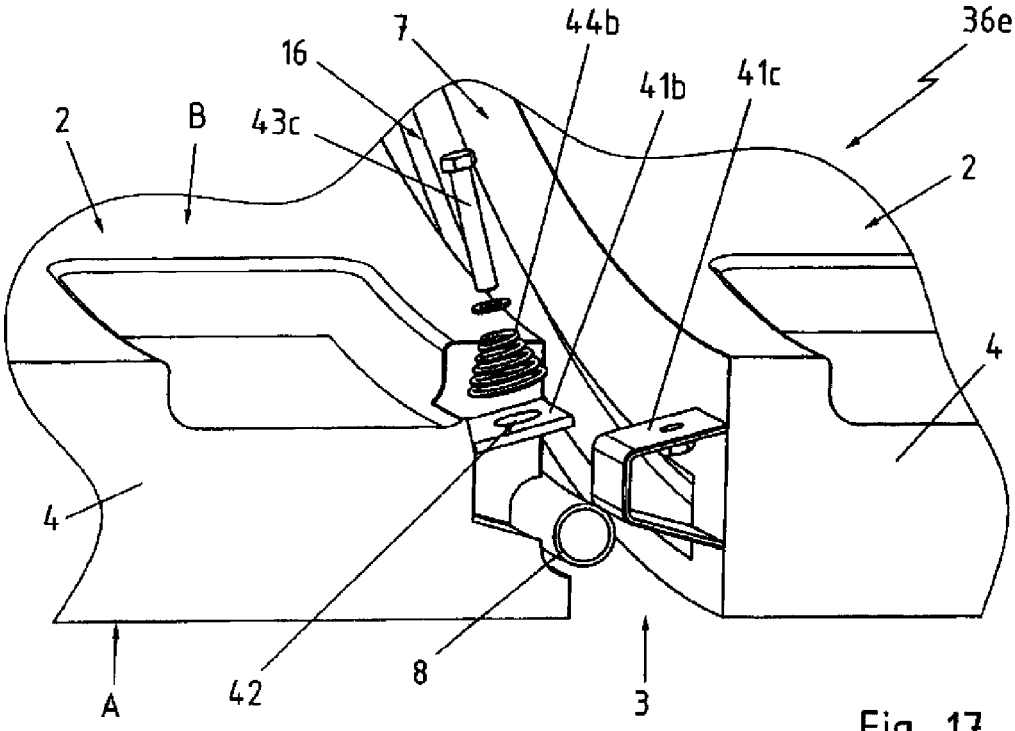
FIG. 17 a coupling unit as a variant of FIGS. 13 to 16 according to the diagrams of FIGS. 15 and 16 in a changed perspective with a changed connection arrangement.

FIG. 17 shows another variant of a coupling unit 36*e*, wherein one of the two counter bearings of the tubbing rings 2 to be connected is formed by an anchor plate 41*b*, whereas the opposite counter bearing has a curved anchor plate 41*c*. Like the anchor plate 41*a*, the anchor plate 41*b* has an clearance opening 42 and is supported in a recess inside one of the tubbing rings 2 in the region of the annular joint 3, wherein the anchor plate 41*b* is integrated in one of the tubbing segments 4 at an acute angle with respect to the inside B. The opposite anchor plate 41*c* is here also fixedly connected with one of the adjacent tubbing rings 2 and is formed as a folded metal strip with a trapezoidal bent shape. This bent shape is received in the opposite counter bearing by the recess in combination with the anchor plate 41*b* coplanar extending at the acute angle with bearing play. The bent anchor plate 41*c* has an interior thread disposed in the region of the opening 42 of the anchor plate 41*b*. The anchor plate 41*b* and the bent anchor plate 41*c* are connected with each other by a bolt 43*c*, wherein the bolt 43*c* includes in analogy to FIGS. 15 and 16 a previously installed spring element 44*b*, which is supported at one end of the bolt 43*c* against its hex head and at the opposite side about the clearance opening 42 of the anchor plate 41*b*.

Figure 18:
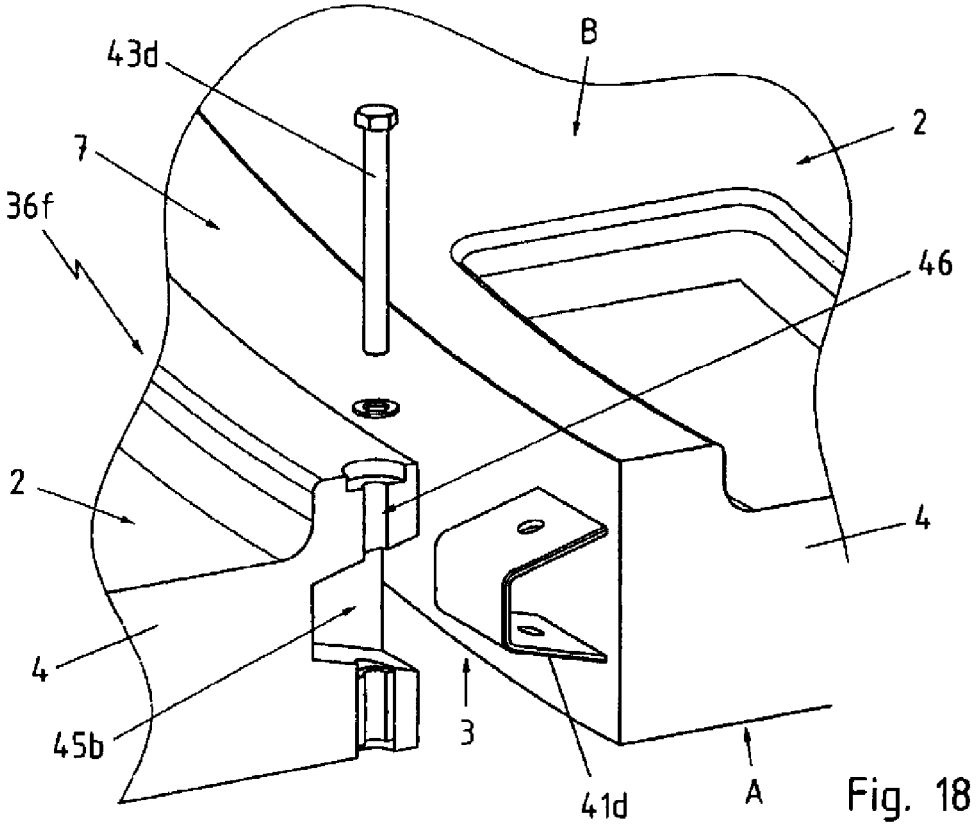
FIG. 18 a coupling unit according to the diagrams of FIG. 17 in a variant with changed coupling faces.

FIG. 18 shows a variant of the coupling unit 36*e* illustrated in FIG. 17. A coupling unit 36*f* is illustrated which has a recess 45*b* and a bolt 43*d* and an anchor plate 41*d*. The recess 45*b* is hereby located in one of the tubbing segments 4 of the tubbing rings 2, which has a shape configured to receive the clearance of the anchor plate 41*d* which is bent like the anchor plate 41*c* and fixedly connected with one of the opposite tubbing segments 4. In addition to the recess 45*b*, the counter bearing has a permanently integrated interior thread and a pass-through opening 46 for insertion of the bolt 43*d*. The bent anchor plate 41*d* has for this purpose two through-bores through which the bolt 43*d* is guided before an exterior thread at one end is connected with the interior thread of the counter bearing.

Figure 19:
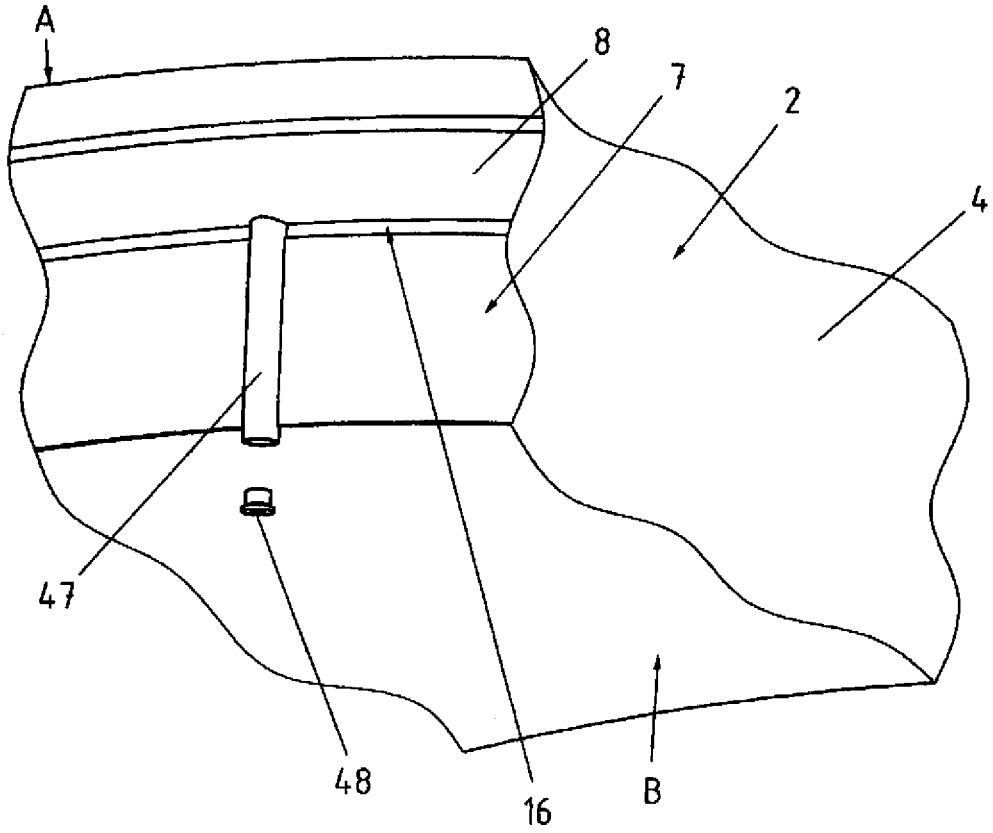
FIG. 19 a seal inside a perspective detail of the end face of a tubbing ring.

FIG. 19 shows a detail of the continuous seal 8 previously illustrated in FIG. 2. As can be seen, one half of the seal 8 is arranged in an annular groove 16 having a predominantly semicircular cross-section. The seal 8 has hereby a connection 47 which is closed by a closure element 48. The connection 47 is constructed as a tubular stub which is connected with the seal 8 embodied as a hollow hose, allowing a medium to flow via the opening of the connection 47 both into and out of the interior space of the seal 8. The connection 47 extends here from the seal 8 inside the annular joint 3 to the inside B of the tubbing rings 2.

In a practical application, a shield driving device with an additional arrangement for installation of a tubbing lining is typically used for constructing an elongated subsurface tunnel section. A round rotating cutting tool is hereby driven into the rock formation. This cutter referred to as shield has openings through which the cutout material can be transported away with conveyor belts.

In the so-called trailer behind the shield, the freshly cut tunnel opening is directly lined with successively arranged tube segments. These tube segments represent a single-shell support structure which satisfies in addition to the static requirements also the requirement for water impermeability. Each of the ring segments is hereby formed of tubbing rings 2 with tubbing segments 4 consecutively arranged with their respective end faces 10 in the circumferential direction.

For optimal adaptation to local situations and requirements, differently prepared tubbing segments 4 are employed. These are of modular construction and equipped at their respective end faces 10 with an adjusting element 5*a*, 5*b* and/or a flexible element 6*a*, 6*b*, 6*c*, 6*d*. The inherently stiff and unyielding tubbing segments 4 made from reinforced concrete are hereby combined into an adaptable and customizable system in form of adjustable tubbing rings 2.

In areas where high dynamic pressures and a large convergence behavior can be expected, the tubbing rings 2 are designed to be flexible by using the flexible elements 6*a*, 6*b*, 6*c*, 6*d* in at least one butt joint 9 between the respective end faces 10 of the tubbing segments 4, thus allowing the tubbing rings 2 to withstand the rock pressure by compressing the flexible element 6*a*, 6*b*, 6*c*, 6*d* and thereby changing the circumference. The forces in the surrounding material are redistributed by increasing the diameter of the tubbing lining 1.

In areas where the diameter of the tunnel borehole must be cut larger when the tunnel tube is driven in, the tubbing rings 2 are designed to be adjustable with the adjusting element 5*a*, 5*b* inserted in the butt joint 9, so that the circumference and hence the diameter of the tubbing rings 2 can be enlarged and adapted to the true borehole diameter.

Tool allows a corresponding changes in the circumference and relative displacement of the individual tube segments, each individual of the tubbing rings 2 is connected with its adjacent tubbing segments by way of a corresponding three-dimensionally yielding coupling unit 36*a*, 36*b*, 36*c*, 36*d*, 36*e*, 36*f* arranged between two corresponding tubbing segments 4 in the region of the annular joint 3. The individual components are thus reliably coupled and positioned with the proper orientation in spite of the yielding connection.

To securely seal the individual tube segments against each other also in the annular joint 3, a continuous annular groove 16, into which a circular seal 8 is inserted, is arranged on each of the front annular surfaces of the tubbing rings 2. The opposing annular surfaces 7 are reliably sealed by the seal 8 with the pressing force in the annular joint 3 against hydraulic pressure. In extreme situations, the seal 8 is embodied as a hose filled with a medium and having an elastically changeable radial cross-section. When the annular joint 3 expands, the seal 8 can still be adapted to the enlarged cross-section by subsequently applying pressure.

What is claimed is:

1. A tubbing lining forming a tubular inner shell for a tunnel or shaft, comprising:

a plurality of tube sections successively arranged in a longitudinal direction, each tube section formed by a tubbing ring having annular end surfaces, wherein the successively arranged tubbing rings are aligned in relation to each other at facing annular end surfaces having an annular groove and forming an annular joint between each two successively arranged tubbing rings, said annular groove configured to accommodate a sealing ring, wherein each tubbing ring comprises a plurality of tubbing segments which are successively arranged in a circumferential direction and have end faces with outer contours, with butt joints being formed between abutting end faces of the tubbing segments, and a deformable flexible element arranged in at least one butt joint and having an outer cross-sectional contour and end faces, wherein the outer cross-sectional contour of the deformable flexible element parallel to the butt joint matches the outer contours of the end faces such that the deformable flexible element completely covers at least one of two abutting end faces, wherein the deformable flexible element comprises a recess in form of a groove formed at the end faces of the deformable flexible element and extending perpendicular to the longitudinal direction and having a substantially semi-circular cross-section that substantially matches a cross-section of the annular groove and is aligned with the annular groove, said recess configured to receive the sealing ring, wherein at least one of the tubbing segments in conjunction with the deformable flexible element forms a common prefabricated element, with the prefabricated element being formed of a steel reinforcing framework encased in concrete to which the deformable flexible element is connected in a force-locked manner.

2. The tubbing lining of claim 1, wherein the deformable flexible element forms a box profile comprising hollow chambers arranged perpendicular to the circumferential direction of the tubbing ring.

3. The tubbing lining of claim 2, wherein the hollow chambers are formed by mutually parallel lands, with first lands extending between two opposing longitudinal walls extending parallel to the end faces and second lands extending between corresponding transverse walls arranged coplanar with the annular end surfaces, wherein the first and second lands intersect at right angles.

4. The tubbing lining of claim 3, wherein the longitudinal walls of the deformable flexible element have an inwardly-facing curvature parallel to a longitudinal axis of the tubbing ring, said curvature making full-area contact with the abutting end faces of the tubbing segments having matching shapes.

5. The tubbing lining of claim 3, wherein the longitudinal walls of the deformable flexible element are each formed of a hollow profile having a cross-section shaped as a segment of an arc, with the arc being disposed in the abutting end faces of the tubbing segments having matching shapes.

6. The tubbing lining of claim 2, wherein the deformable flexible element has two opposing longitudinal walls extending parallel to the end faces, wherein the hollow chambers are disposed between the opposing longitudinal walls and formed from a plurality of individual tubular bodies arranged row-wise parallel to the longitudinal walls and contacting each other along the circumferential direction, and wherein at least one intermediate land is disposed between two adjacent rows.

7. The tubbing lining of claim 1, further comprising an adjusting element arranged in a butt joint and constructed to change a distance between abutting end faces.

8. The tubbing lining of claim 7, wherein the deformable flexible element is a compressible part of the adjusting element.

9. The tubbing lining of claim 1, further comprising a coupling unit constructed to releasably connect one tubbing ring with an adjacent tubbing ring to provide three-dimensional flexibility.

10. The tubbing lining of claim 1, wherein the seal is incorporated in the annular joint and extends continuously around the annular end surface.

11. The tubbing lining of claim 1, wherein the seal is formed of a solid material or of a hose constructed to be filled with a material.

* * * * *